US006860573B2

(12) United States Patent
Dunn et al.

(10) Patent No.: US 6,860,573 B2
(45) Date of Patent: Mar. 1, 2005

(54) WEATHER RESISTANT DOCUMENT CASE

(76) Inventors: Gary D. Dunn, 2368 Podocarpus Way, Clearwater, FL (US) 34619; Carole Anne Dunn, 2368 Podocarpus Way, Clearwater, FL (US) 34619

( * ) Notice: Subject to any disclaimer, the term of this patent is extended or adjusted under 35 U.S.C. 154(b) by 252 days.

(21) Appl. No.: 10/154,908

(22) Filed: May 28, 2002

(65) Prior Publication Data

US 2003/0222542 A1 Dec. 4, 2003

(51) Int. Cl.[7] ..... A47B 81/00
(52) U.S. Cl. ..... 312/100; 312/296
(58) Field of Search ..... 312/100, 101, 312/102, 326, 296

(56) References Cited

U.S. PATENT DOCUMENTS

| | | | | | |
|---|---|---|---|---|---|
| 454,769 | A | | 6/1891 | Roberts | |
| 1,370,635 | A | | 3/1921 | Draper | |
| 1,453,658 | A | | 5/1923 | Clough | |
| 1,527,899 | A | | 5/1925 | Stubbs | |
| 2,315,158 | A | * | 3/1943 | Markham | 312/100 |
| 3,645,594 | A | * | 2/1972 | Cintz | 312/100 |
| 3,659,355 | A | | 5/1972 | Aubin, Jr. | |
| 4,209,212 | A | | 6/1980 | McGoldrick | |
| 4,304,447 | A | | 12/1981 | Ellwood et al. | |
| 4,337,590 | A | | 7/1982 | Jackson | |
| 4,726,634 | A | * | 2/1988 | Dewees et al. | 312/100 |
| 4,821,440 | A | | 4/1989 | Dunn | |
| 4,997,088 | A | * | 3/1991 | Spry | 206/449 |
| 5,048,900 | A | | 9/1991 | Nunn | |
| 5,054,862 | A | * | 10/1991 | Vanaman | 312/100 |
| 5,094,355 | A | * | 3/1992 | Clark et al. | 220/4.23 |
| 5,096,084 | A | * | 3/1992 | Wells | 220/835 |
| 5,623,778 | A | | 4/1997 | Dunn | |
| 5,664,851 | A | | 9/1997 | Dunn | |
| 5,671,951 | A | * | 9/1997 | Palmiter et al. | 281/31 |
| 5,915,581 | A | * | 6/1999 | Pfirrmann et al. | 220/4.21 |
| 6,012,786 | A | | 1/2000 | Dunn | |
| 6,479,795 | B1 | * | 11/2002 | Albrecht et al. | 219/137.2 |
| 6,505,774 | B1 | * | 1/2003 | Fulcher et al. | 235/381 |

FOREIGN PATENT DOCUMENTS

| | | | | |
|---|---|---|---|---|
| DE | 1018717 | | 7/1970 | |
| FR | 22706554 | | 12/2000 | |
| GB | 2131002 A | * | 6/1984 | 312/100 |

* cited by examiner

*Primary Examiner*—Hanh V. Tran
(74) *Attorney, Agent, or Firm*—Siemens Patent Svcs LC

(57) ABSTRACT

A light weight, weather resistant document case which may be economically formed as a single piece by either vacuum forming or injection molding and shipped, in mass, in a nested configuration for final, simple assembly by the consumer. Due to the economies of production and shipping, the inventive document case, while relatively durable, may be considered disposable and recyclable. The document case has a top cover and a bottom housing which matingly engages with one another by protruding notches and a corresponding recess. The protruding notches are arranged and configured such that draining recesses are formed when the document case is in a closed state. Specialized graphic and/or textual displays may be molded, printed, or adhered to the case.

20 Claims, 8 Drawing Sheets

WEATHER RESISTANT DOCUMENT CASE

BACKGROUND OF THE INVENTION

1. Field of the Invention

The present invention relates to cases and cabinets for storing and displaying documents and other objects, especially outdoors. The invention incorporates features particularly suitable for exterior mounting of the case, for providing weather protection, and for accepting insertion and storage of diverse articles in the case.

2. Description of the Prior Art

It is frequently necessary to display or store documents on diverse outdoor sites, such as construction sites, campsites or swimming pool complexes. By their very nature, these sites are ill suited to accommodate paper documents and small personal articles which may be necessary or desirable to have at hand, many of which are required by municipal authorities, maintenance personnel or others, to be prominently displayed on site.

The present invention improves upon prior art display cases, including the present inventor's prior U.S. Pat. Nos. 6,012,786, issued on Jan. 11, 2000; 5,664,851, issued on Sep. 9, 1997; 5,623,778, issued on Apr. 29, 1997; and 4,821,440, issued on Apr. 18, 1989. Display of permits and other documents is the principal function of these devices. Each describes a durable case having a clear or transparent hinged cover and an internal tack board for securing paper documents by tacks, staples, or other fasteners in a visible condition. The device is intended primarily for convenient, protected display of documents which are generally required to be visible and accessible to passers by.

U.S. Pat. No. 5,048,900, issued to Gene Nunn on Sep. 17, 1991, discloses a wall mounted storage cabinet for the storage of items such as grinder plates and rotary knife blades as are used in a butcher shop. The wall mounted box has a plurality of hanging devices for storing the plates and knives, while a hinged door has a window allowing visual access to the hinging objects. A second chamber in the wall mounted box, having a separate hinged door for separately storing dirty plates and knives.

U.S. Pat. No. 4,304,447, issued to Gloria Ellwod, et al., on Dec. 8, 1981, discloses a wall mounted box having an ornamented, hinged door enclosing the entire wall mounted box.

U.S. Pat. No. 4,337,590, issued to Harold Jackson on Jul. 6, 1982, discloses a case having backing member, over which a message sheet may be placed, having a clear, hinged cover to protect the displayed message sheet.

U.S. Pat. No. 4,209,212, issued to Darlene M. McGoldrick on Jun. 24, 1980, describes a display case having a clear or transparent door and a mounting board disposed within the base portion of the display case. The mounting board has a plurality of nails or the like from which jewelry may be suspended. These features are similar to some of those of the present invention. However, McGoldrick is silent regarding molded construction as seen in the novel display case, as well as regarding the many unique features of the novel display case.

U.S. Pat. No. 3,659,355, issued to Adeiard L. Aubin, Jr., on May 2, 1972, discloses a wall mounted chalkboard, projection screen and information display apparatus. A wall mounted box contains a tack surface on its rear, interior surface, a pull down projection screen, and storage for sundry items, such as erasers. Hinged doors closing the wall mounted box hold a pair of chalk boards.

U.S. Pat. No. 1,537,899, issued to Clendenon L. Stubbs on May 12, 1925, discloses holder for displaying a document such as a vehicle registration card. A box, having a spring therein, is mounted to the body of a vehicle. The spring constrains a document against the interior, rear wall of the box, hidden from view, while springs within a hinged door having a transparent panel, constrain a document to be displayed against the transparent panel.

U.S. Pat. No. 1,453,658, issued to George B. Clough on May 1, 1923, discloses a display board for gasoline prices, wherein a hinged cover with a transparent window overlays a mounted box containing tilt out panels, each panel adapted to receive a single document, such as a single digit of a price. A separate window in the cover panel has a channel mounted on the interior for displaying a single line message.

U.S. Pat. No. 1,370,635, issued to Talbert A. Draper on Mar. 8, 1921, discloses a card holder for a freight car, comprising a mounted box having a hinged door. A pocket within the box holds a document against the rear, interior wall of the box. The door contains a transparent panel for displaying a portion of the document contained within the box, plus a plurality of additional transparent panels, each having a spring clip which holds a document, such as a car number, against the interior of the panel. A protruding lip at the top of the mounted box provides an overhang to prevent water from entering the top of the closed box.

U.S. Pat. No. 454,769, issued to William E. Roberts on Jun. 23, 1891, discloses an advertising device. A box has a ribbed back board into which tabs of individual letters may be inserted for spelling out a message. A clear paneled door overlays the box to prevent tampering with the message.

French Patent Number 2,270,654, dated Dec. 5, 1975, shows a display case having a transparent cover and a rear surface configured to cooperate with a supporting post or the like. However, the rear surface does not accommodate different orientations of the post relative to the display cabinet, as provided in the present invention.

German Patent Number 1,018,717, issued on Oct. 31, 1957, discloses a box, having a transparent cover, in which a document may be constrained by a wire bale hinged at the top of the box such that it runs down the two sides of the box and is clipped into position at the bottom of the box.

In summary, the prior art shows some of the features of the present invention, but these features vary from corresponding features in the present invention. Furthermore, construction of a each case cited tends to be of a durable nature while the present invention's design is more adapted to temporary use, and disposibility of the case, which is not shown in the prior art.

None of the above inventions and patents, taken either singly or in combination, is seen to describe the instant invention as claimed.

SUMMARY OF THE INVENTION

The display of documents is required in outdoor locations for a variety of reasons. In many situations a durable display case may be required, but in many other situations all that is required is protection for a relatively short period of time or in a relatively protected area.

The present invention fills the need for a low cost, disposable document box by providing a box which may be vacuum formed from flat stock and shipped in an open and nested state, thereby reducing shipping volume. Simple, final assembly steps may be performed by the consumer.

Accordingly, it is a principal object of the invention to provide a weather resistant document case which is light weight.

It is another object of the invention to provide a weather resistant document case which is durable.

It is a further object of the invention to provide a weather resistant document case which may have a transparent front face.

Still another object of the invention is to provide a weather resistant document case which has document containment and/or restraint features within the box.

An additional object of the invention is to provide a weather resistant document case may bear various printed indicia on the front face thereof.

It is again an object of the invention to provide a weather resistant document case which may bear various embossed indicia on the front face thereof.

Yet another object of the invention is to provide a weather resistant document case which is disposable.

Still another object of the invention is to provide a weather resistant document case which is recyclable.

Another object of the invention is to provide a weather resistant document case which is inexpensive to manufacture, and therefore inexpensive to purchase.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figure 1:
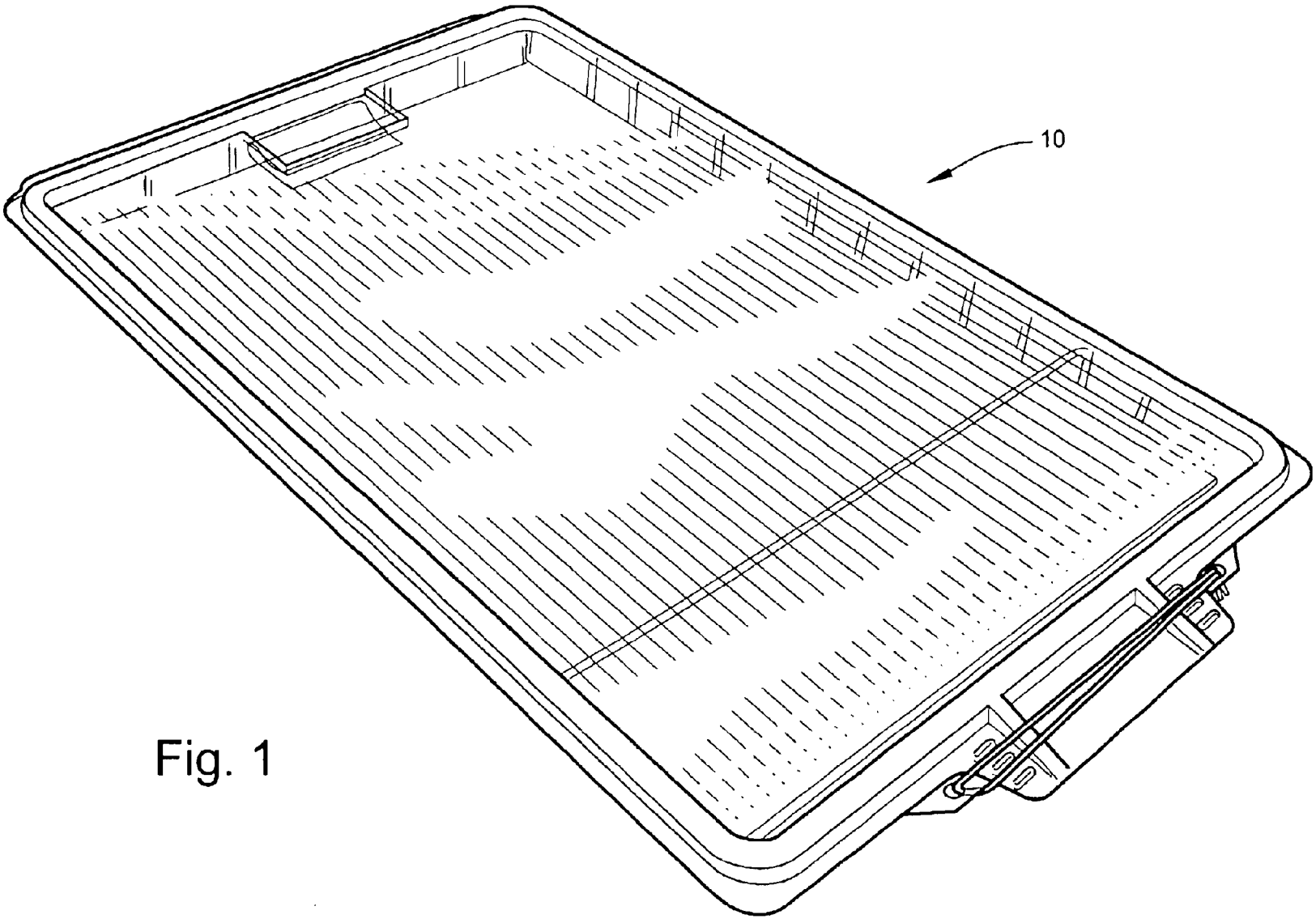
FIG. 1 is an environmental perspective view of the inventive document case in a closed state.

FIG. 1 is a front perspective of the inventive document case 10, generally identified at 10 throughout the corresponding figures. The document case 10 is typically formed by injection or vacuum molding of a polymeric material, which may be of a transparent, translucent or opaque nature, or having the various elements formed of a combination thereof. The document case 10 generally comprises a bottom housing 20 and a top cover 40.

Figure 2A:
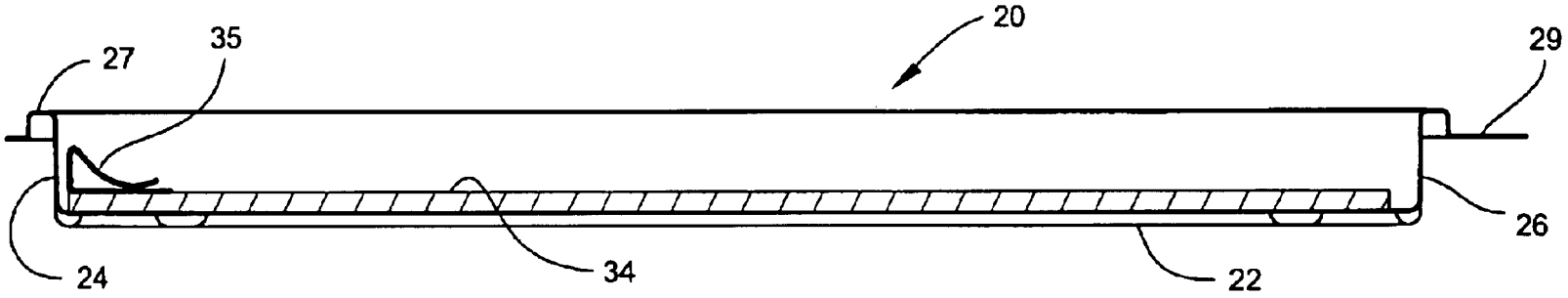
FIG. 2A is a cross sectional view of the bottom housing of the inventive document case.
Figure 2B:
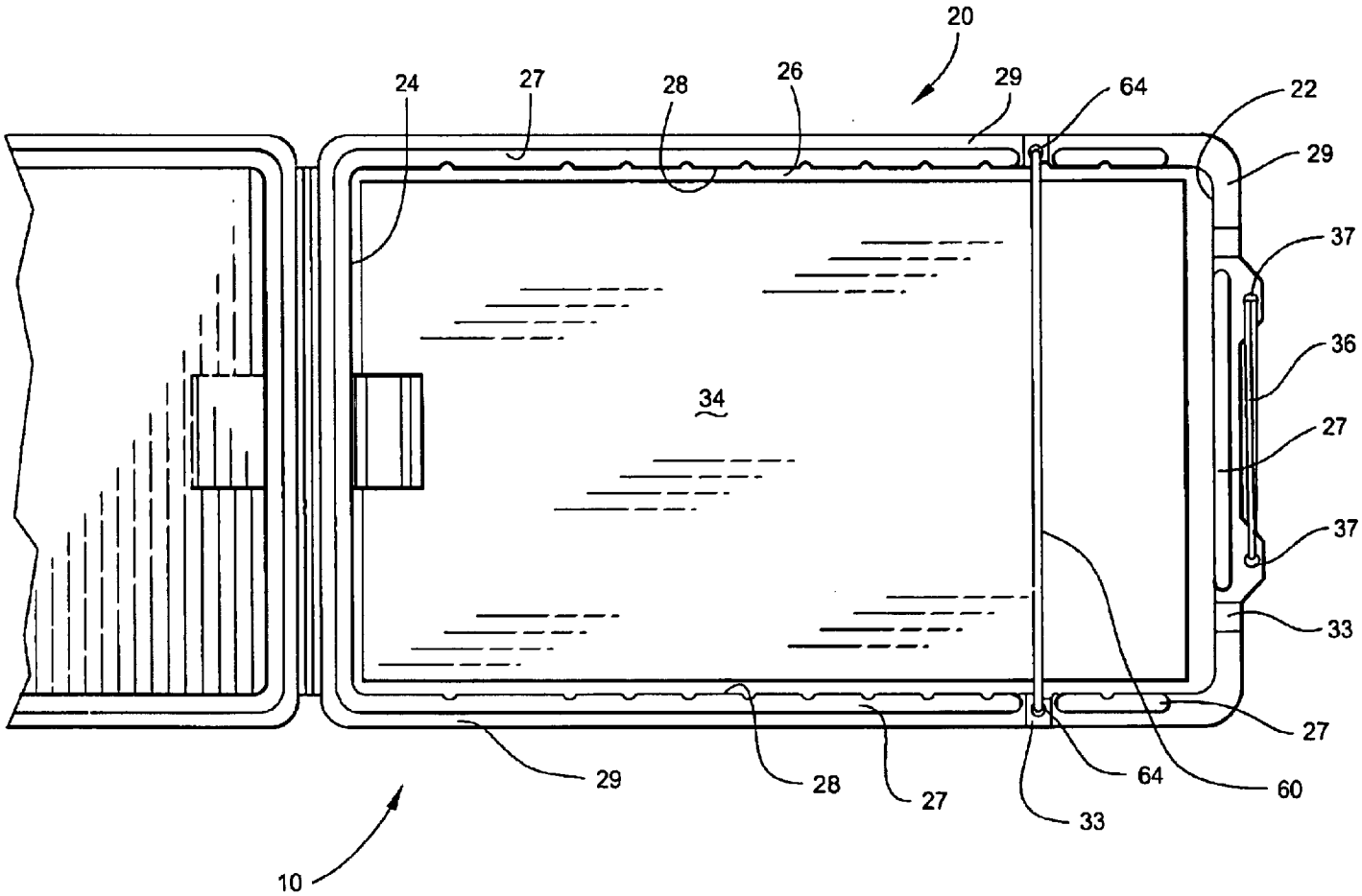
FIG. 2B is a top plan view of the bottom housing of the inventive document case.
Figure 2C:
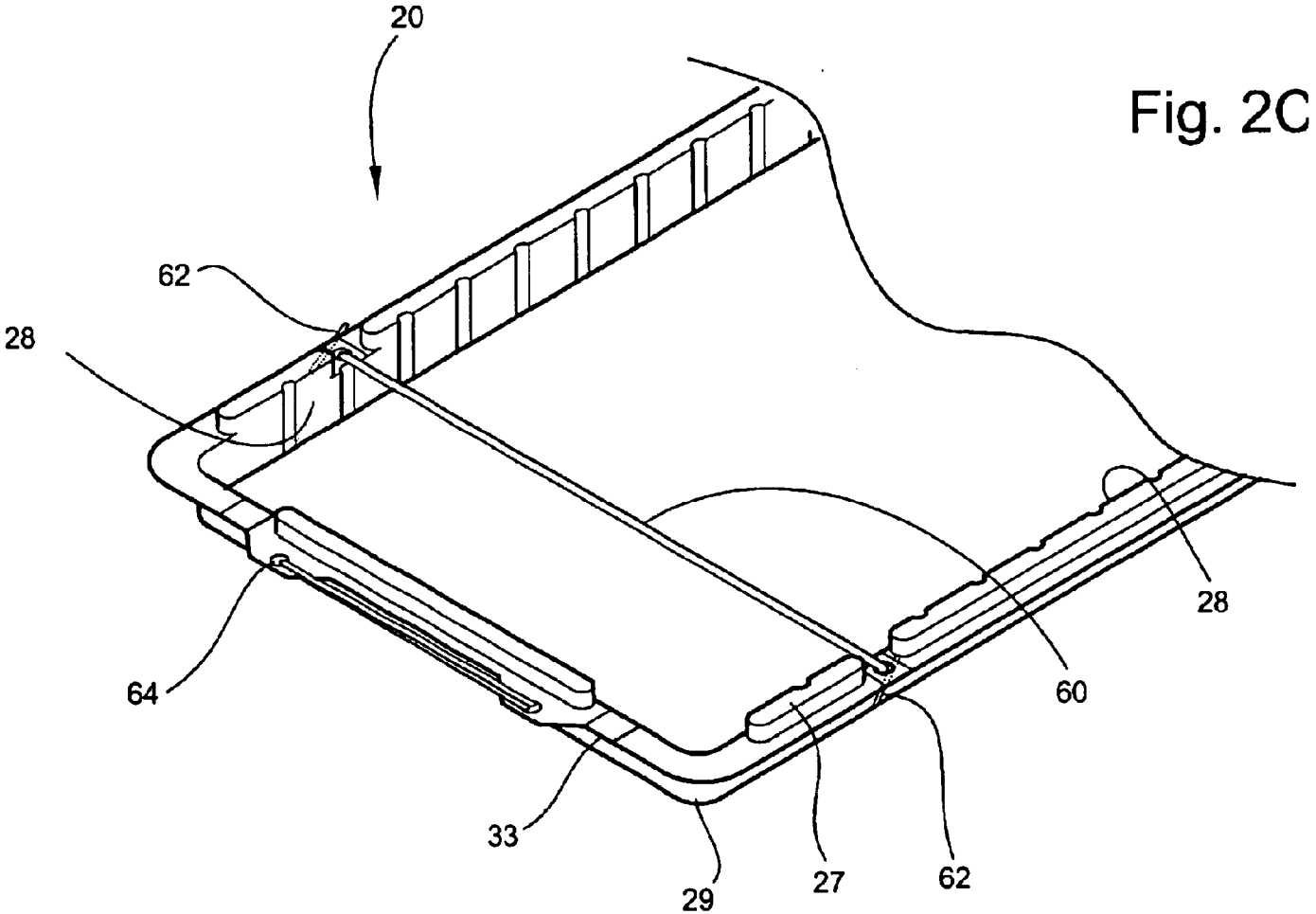
FIG. 2C is a side perspective view of the bottom housing of the inventive document case.

FIGS. 2A–C illustrate the bottom housing 20 in further detail. The bottom housing 20 has a substantially rectangular bottom wall 22, and a top wall 24, a back wall 26, and two side walls 28 rising from bottom wall 22. Each of the top wall 24, back wall 26, and side walls 28 are all substantially normal to one another at their juncture and flare at an angle of slightly more than 90° as they rise from bottom wall 22. The flare facilitates shipping by allowing nesting of a plurality of document cases 10 in an open position.

The top view of bottom housing 20, as shown in FIG. 2B, better illustrates the mechanisms which constitute the secure closure of the document case 10. The edges of the document case 10 are formed by a perimeter lip 29. This perimeter lip 29, extends laterally from each of the walls 24, 26 and 28. The perimeter lip 29 has protruding notches 27 formed therein. These protruding notches 27 are formed by a raised protrusion in the perimeter lip 29 thereby forming a raised profile of the edge of the document case 10. As shown in FIG. 2B, the protruding notches 27 may be noncontinuous in its formation around the edge within the perimeter lip 29. The discontinuity thereby forming a series of protruding notches 27 in the perimeter lip 29. The protruding notches 27 having a height dimensioned and configured to matingly engage the top cover 20 (discussed further below).

Between the series of protruding notches 27 are draining recesses 33. Since a primary objective of the present invention is to keep documents, and other enclosed items, free of moisture, draining recesses 33 permit any interior fluids to drain when the document case 10 is in a closed state. The draining recesses 33 also aid in prohibiting any moisture and condensation to accumulate by providing ventilation. The recesses 33 may be placed along the perimeter lip 29 such that interior convection currents are created which can encourage airflow.

To further aid in maintaining secure closure of the document case 10, there is provided a handle bungee 36 which is adapted to stretch over the handle tab 41, of the top cover 20, when the document case 10 is in a closed position. This handle bungee 36 is a restraining strap made of an elastic material which facilitates closure. The handle bungee 36 may be held in place by end clips at each end; and each end clip fit into notches 37 formed in the perimeter lip 29 adjacent the bottom wall 26 in bottom housing 20.

The bottom housing 20 may also be equipped with a lightweight tack board 34 adhered to the internal surface of bottom wall 22 to facilitate posting of documents with thumbtacks, staples, or the like. Likewise, either a friction or spring loaded clip 35 may be mounted on tack board 34 proximate top wall 24 to retain papers in place within the document case 10 (FIG. 2C).

Figure 4:
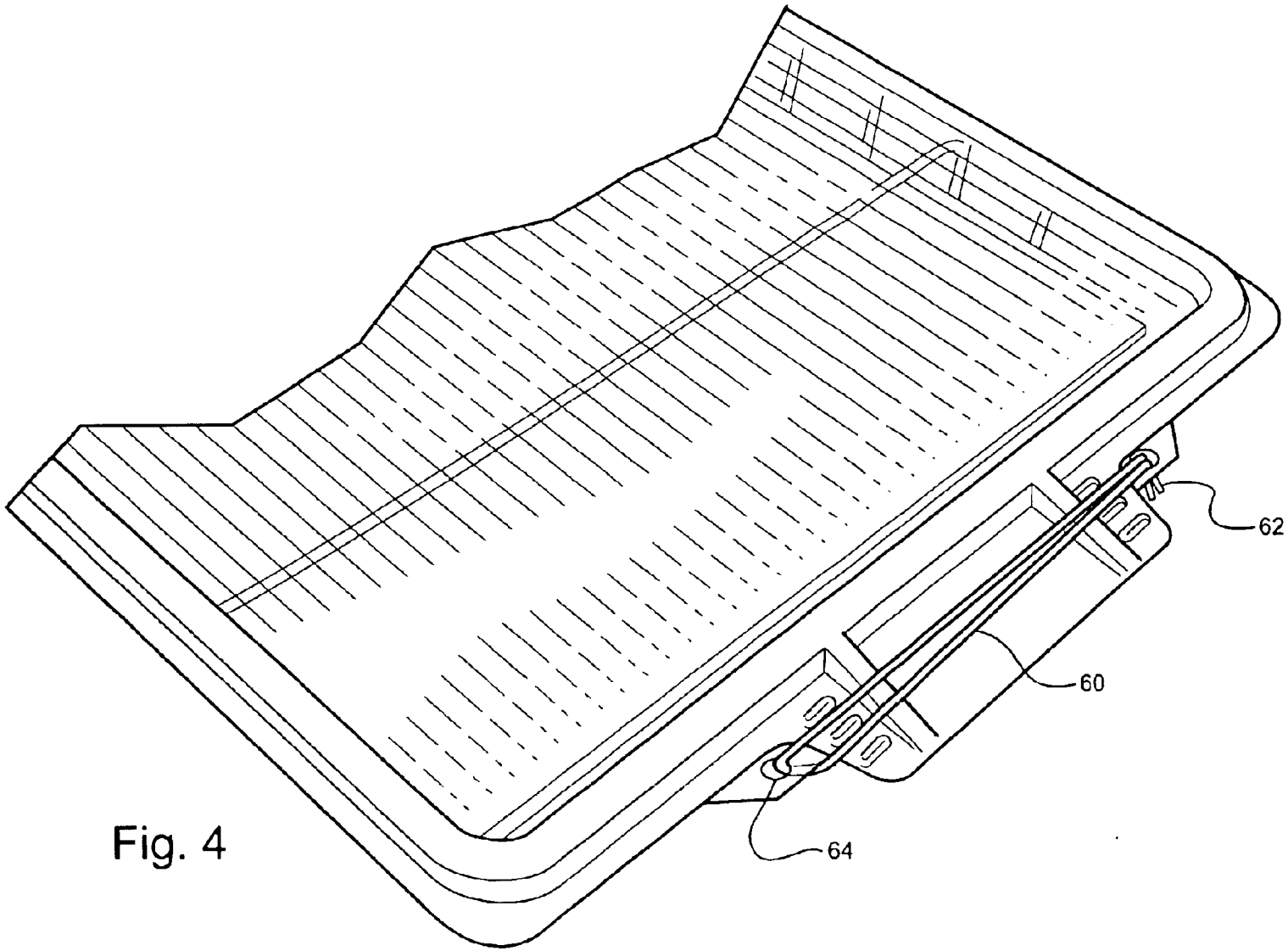
FIG. 4 is a cross sectional view of the inventive document display case in its closed state.

An additional feature of the document case is a restraining strap 60, as shown in FIG. 2C and FIG. 4. The restraining strap 60 may be comprised of an elastic material stretched across the expanse of the bottom housing 20 and attached on the left and right sides along side walls 28. Restraining strap 60 may be held in place by an end clip 62 at each end of restraining strap 60, each end clip fit into a notch 64 in the side walls 28. It would be evident to one skilled in the art that restraining strap 60 could be placed at any point along the vertical height of bottom housing 20, more than one restraining strap 60 could be utilized, or that a similar restraining strap could be incorporated into the top cover 40, as well. Restraining strap 60 is used to restrain documents within the document case 10.

Figure 3A:
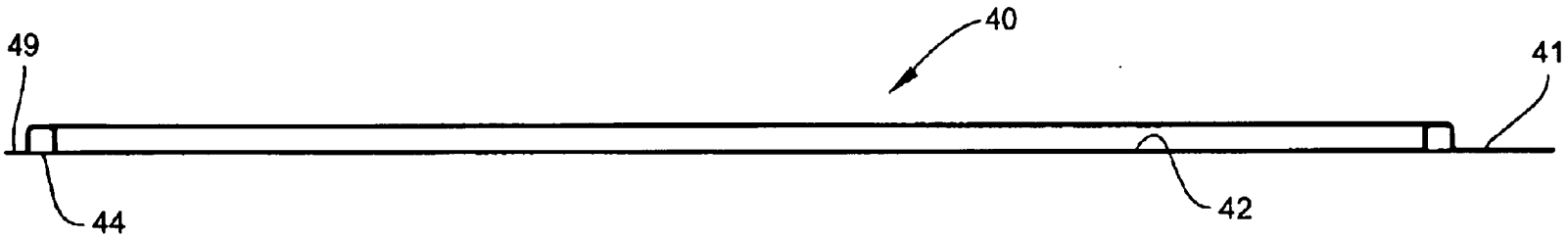
FIG. 3A is a cross sectional view of the top cover of the inventive document case.
Figure 3B:
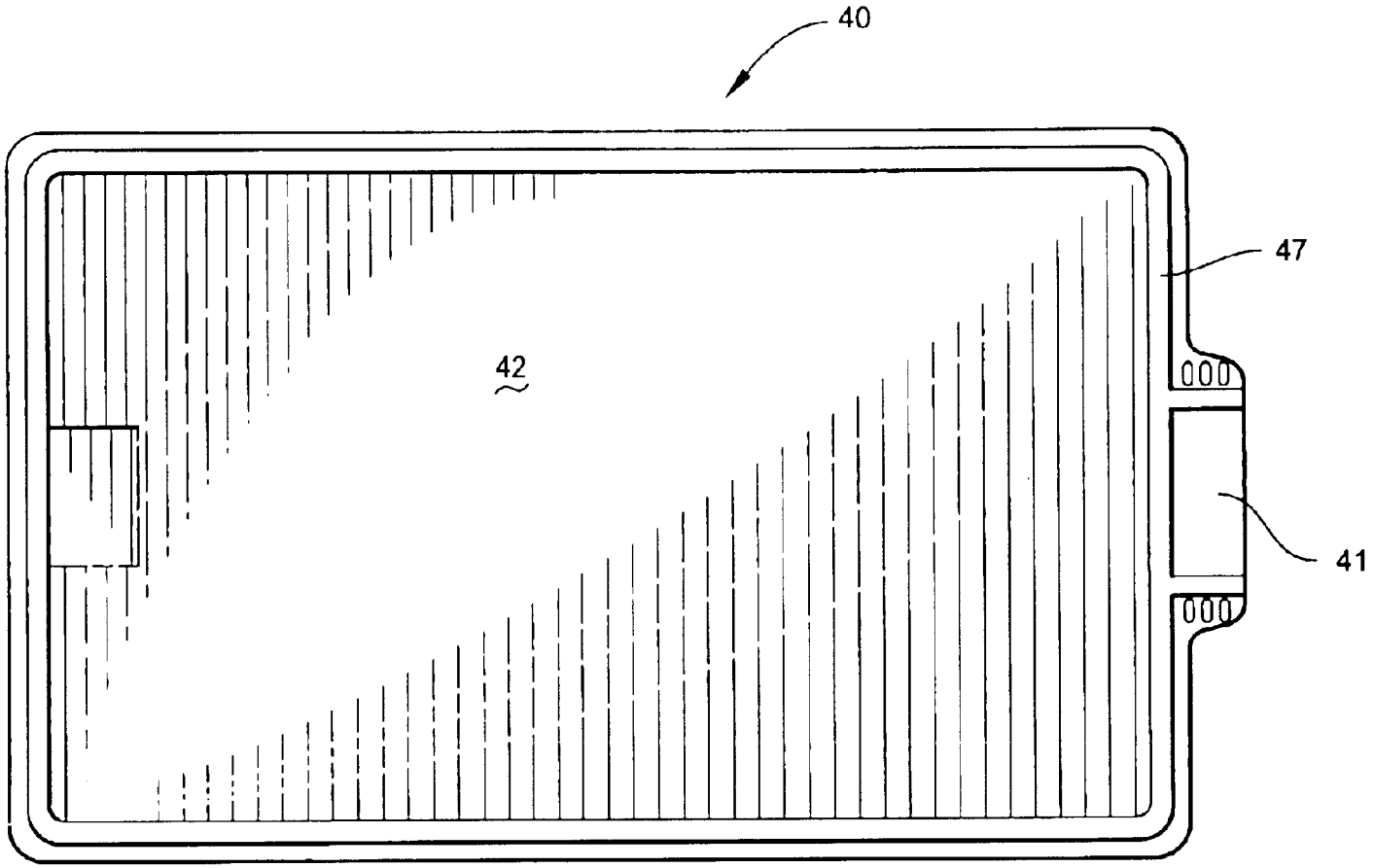
FIG. 3B is a top plan view of the top cover of the inventive document case.

Likewise, as shown in FIGS. 3A and 3B, the top cover 40 is substantially rectangular having perimeter dimensions substantially equal to those of the aforementioned bottom housing 20 for fitted closure of the document case 10. The top cover 40 may be formed of a substantially flat configuration forming a cover top wall 42 having a raised perimeter recess 44 forming the edges of the top cover 40. Extending laterally from the perimeter recess 44 is an upper perimeter lip 49 forming the outermost edge of the top cover 40.

The perimeter recess 44 of the top cover is dimensioned and configured to snugly receive the protruding notches 27 of the bottom housing 20, as shown in the side view of FIG. 4. For mating engagement, the perimeter recess 44 of top cover 40 is of a depth substantially equal to the height of protruding notches 27 of the bottom housing 20. Again, to facilitate nesting of a plurality of document cases 10 in open position for shipping, the depth of the perimeter recess 44 may increase at an angle, relative to cover top wall 42. It would be evident to one skilled in the art that the locations of the protruding notches 27 may vary and that equivalent catch systems known in the art could be used with equivalent effectiveness without materially changing the inventive document case 10.

In order to increase the rigidity of document case 10, various ridges or other forms of embossing could be formed in bottom wall 22, handle tab 41, cover top wall 42 and top wall 24, back wall 26, and side walls 28. It would be further evident that cover top wall 42, or any other surface, could be embossed with a textual or graphic display, such as a company logo or instructions. Printed displays could also be imprinted within the document case along any surface (e.g., in a raised fashion) or printed either directly on any outer surface, or any inner surface. In a transparent or translucent embodiment, printed displays may be an adhered decal.

Figure 5A:
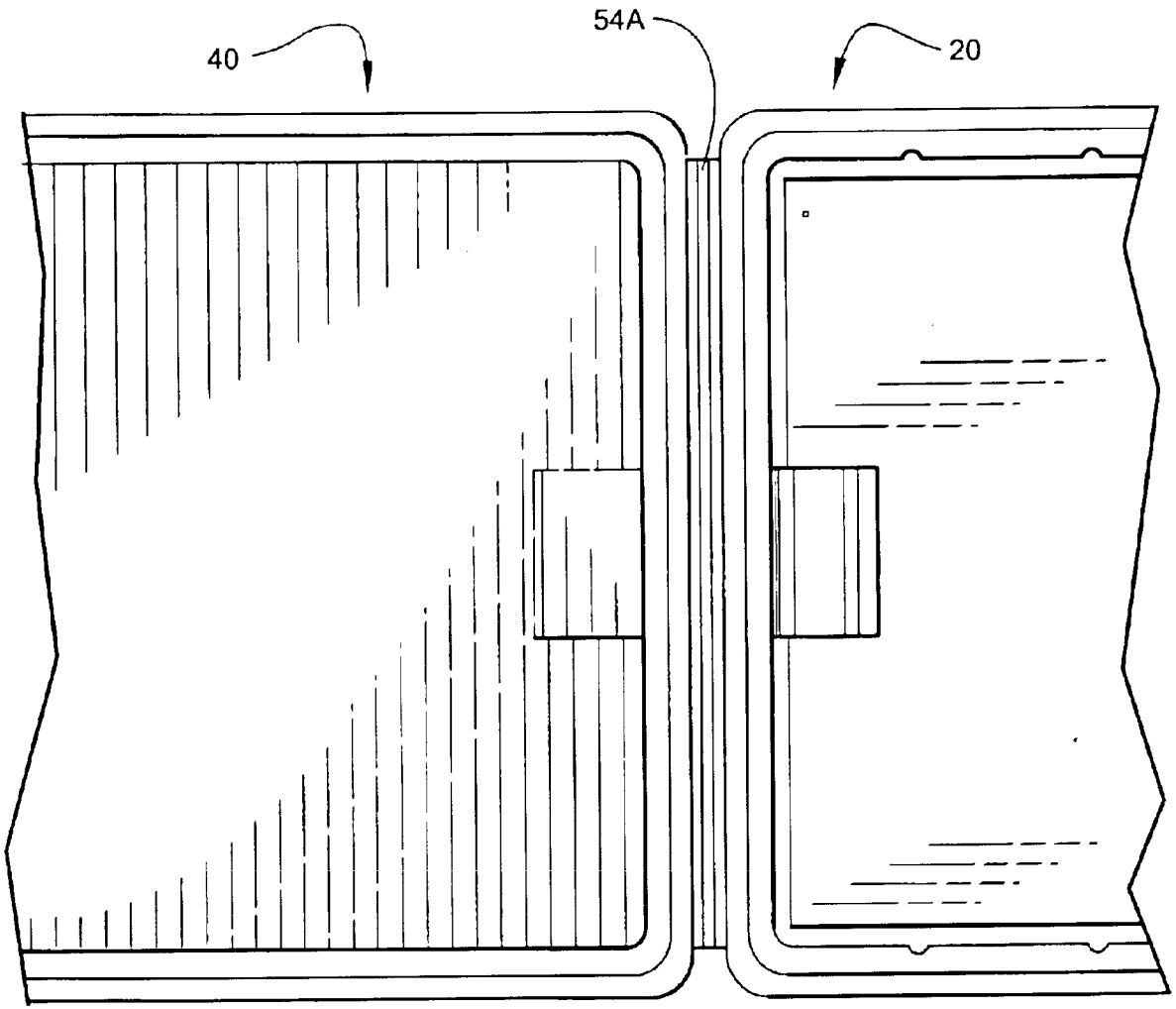
FIG. 5A is an environmental perspective view of a first embodiment of the inventive document case, molded as a single piece with an integral hinge, in an open state.
Figure 5B:
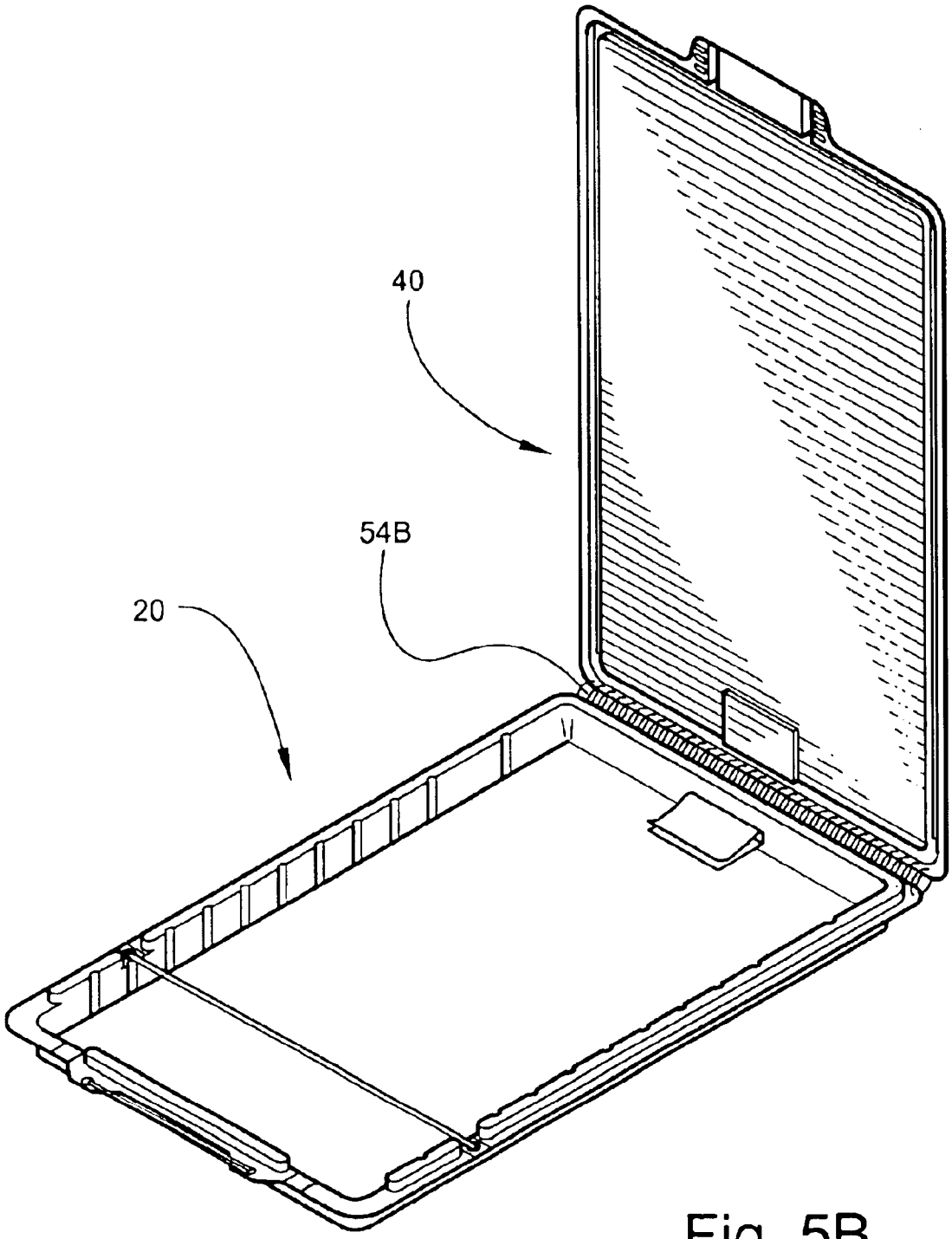
FIG. 5B is an environmental perspective view of the first embodiment of the inventive document case of FIG. 5A, molded as two separate pieces, with a separately formed hinge.

As illustrated in FIG. 5A, rear housing 20 and cover housing 40 are joined, preferably along their upper edges by a hinge 54A formed in the molding process. A top hinge 54A provides a solid joint to provide added weather resistance along the top surface, but it would be evident to one skilled in the art that hinge 54A could be formed along any edge. It would be further evident to one skilled in the art that rear housing 20 and cover housing 40 could be formed separately, as illustrated in FIG. 5B, and joined by a separate hinge means 54B, diagrammatically illustrated.

It would be evident to one skilled in the art that the exact size and shape of the document case 10 is of little significance and could be modified to fit specific requirements without varying from the intent of the inventive concept disclosed herein. It would, likewise, be evident to one skilled in the art that the cross sectional profiles of protruding notches 27, perimeter recess 47, perimeter lips 29 and 49, and handle tab 41 may be modified, without departing from the basic intent of the invention.

It is to be understood that the present invention is not limited to the embodiments described above, but encompasses any and all embodiments within the scope of the following claims.

What is claimed is:

1. A weather resistant document case comprising:

a) a bottom housing, said bottom housing having a back wall, a top wall, a bottom wall and two side walls, said top wall, bottom wall and two side walls substantially normal to one another at their junctures and flaring at an angle substantially normal to said back wall, each of said top wall, bottom wall, and two side walls having a perimeter lip extending laterally therefrom in a plane perpendicular to said walls, a first sealing means incorporated within said perimeter lip for sealing the interior of said document case from the weather, draining means, formed within said perimeter lip, for providing drainage of fluid and ventilation of condensation accumulation within the document case;

b) a top cover, said top cover being substantially flat forming a top wall and having a perimeter edge extending laterally therefrom, and having a second sealing means incorporated within said perimeter edge for sealing the interior of said document case from the weather;

wherein said first sealing means and said second sealing means are adapted for coupling to one another thereby providing weather resistance when the document case is in a closed position, c) joining means for joining said bottom housing and said top cover, thereby forming an interior of said case when joined in a closed position.

2. A weather resistant document case, as defined in claim 1, wherein said case is comprised of materials from the group: vacuum formed polymers and injection molded polymers.

3. A weather resistant document case, as defined in claim 1, wherein said bottom housing and said top cover are formed as a single element wherein said joining means comprises an integral hinge formed therebetween.

4. A weather resistant document case, as defined in claim 1, wherein said bottom housing and said top cover are formed as separate elements wherein said joining means comprises a hinge formed separately from said bottom housing and said top cover.

5. A weather resistant document case, as defined in claim 1, wherein said top cover further comprises a handle tab, said handle tab formed within and extending beyond the perimeter lip of said bottom housing.

6. A weather resistant document case, as defined in claim 1, wherein:

said draining means comprises a plurality of recesses formed within said perimeter lip of the bottom housing.

7. A weather resistant document case, as defined in claim 6 wherein:

said plurality of recesses are located in spatial relations such that cross ventilation occurs due to convection currents.

8. A weather resistant document case, as defined in claim 1, wherein:

said first sealing means comprises a plurality of protruding notches, and said second sealing means being comprised of a perimeter recess, wherein said plurality of notches frictionally engages the perimeter recess thereby providing secure closure of said top cover and bottom housing and providing additional weather seal.

9. A weather resistant document case, as defined in claim 8, wherein said bottom housing further comprises a tack board, said tack board adhered to an interior surface of said back wall and adapted to receive fastening devices for fastening documents to said tack board.

10. A weather resistant document case, as defined in claim 9, wherein said tack board further comprises a retaining clip affixed to a front surface of said tack board proximate said top wall of said bottom housing.

11. A weather resistant document case, as defined in claim 10, wherein said retaining clip comprises a friction clip whereby a document is retained by friction between said document and a front portion and a rear portion of said retaining clip.

12. A weather resistant document case, as defined in claim 10, wherein said retaining clip comprises a spring loaded clip whereby a document is retained by pressure exerted upon said document by spring exerted pressure of a front portion of said retaining clip against said document and a rear portion of said retaining clip.

13. A weather resistant document case, as defined in claim 8, further comprising a restraint strap disposed between said perimeter lip on each of said two side walls of said bottom housing, said restraint strap adapted to restrain documents within said document case; and a handle bungee located in said perimeter lip proximate said bottom wall of the bottom housing, said handle bungee affixed to said perimeter lip via notches formed within the perimeter lip.

14. A weather resistant document case comprising:

a bottom housing, said bottom housing having a back wall, a top wall, a bottom wall and two side walls, said top, bottom and two side walls all substantially normal to one another at their junctures and flaring at an angle exceeding 90° relative to said back wall, each of said top wall, bottom wall, and two side walls having a proximal lip extending laterally therefrom in a plane perpendicular to said walls, said perimeter lip having at least one protruding notch formed therein;

a top cover forming a substantially flat top wall and having a perimeter edge extending laterally therefrom, said perimeter edge having a perimeter recess formed along each side, and wherein said at least one protruding notch of said bottom housing is adapted to matingly engage with said perimeter recess of said top cover, joining means for joining said bottom housing and said top cover, to thereby form an interior of said case when joined in a closed position;

mounting means for mounting at least one document within said document case; and restraining means for restraining at least one document in said document case.

15. A weather resistant document case, as defined in claim 14, wherein:

said mounting means comprising a tack board adhered to an interior surface of said back wall of said rear housing and adapted to receive fastening devices for fastening documents to said tack board, and said mounting means further comprising a retaining clip affixed to a front surface of said tack board proximate said top wall of said bottom housing.

16. A weather resistant document case, as defined in claim 14, wherein said document case is formed of materials from the group: vacuum formed polymers and injection molded polymers.

17. A weather resistant document case, as defined in claim 14, wherein said bottom housing and said top cover are formed as a single element wherein said joining means comprises an integral hinge formed therebetween.

18. A weather resistant document case, as defined in claim 14, wherein said bottom housing and said top cover are formed as separate elements wherein said joining means comprises a hinge formed separately from said bottom housing and said top cover.

19. A weather resistant document case, as defined in claim 15, wherein said perimeter lip further comprises at least one drain recess formed therein, said drain notch adapted to allow condensate to drain from the interior of said document case.

20. A weather resistant document case, as defined in claim 19, wherein said restraining means comprises a restraint strap disposed between each of two side walls of said bottom housing, said restraint strap being affixed thereto by an end clip affixed at each of two ends of said restraint strap, each of said end clips disposed to matingly engage slots formed in said side walls; and a handle bungee located in said perimeter lip proximate said bottom wall of the bottom housing, said handle bungee affixed to said perimeter lip via notches formed within the perimeter lip.

* * * * *